US008408909B1

(12) United States Patent
Preston et al.

(10) Patent No.: US 8,408,909 B1
(45) Date of Patent: Apr. 2, 2013

(54) NON-PYROTECHNIC CUEING DEVICE

(75) Inventors: Steven Gordon Preston, Winter Springs, FL (US); Charles Thomas Penrose, Oakland, FL (US)

(73) Assignee: Lockheed Martin Corporation, Orlando, FL (US)

( * ) Notice: Subject to any disclaimer, the term of this patent is extended or adjusted under 35 U.S.C. 154(b) by 365 days.

(21) Appl. No.: 12/952,736

(22) Filed: Nov. 23, 2010

(51) Int. Cl.
*F41A 33/00* (2006.01)

(52) U.S. Cl. ..... 434/11

(58) Field of Classification Search ..... 434/11, 434/14, 15, 16, 17; 102/200, 202, 205, 206, 102/217, 224
See application file for complete search history.

(56) References Cited

U.S. PATENT DOCUMENTS

| | | | |
|---|---|---|---|
| 4,416,631 | A | 11/1983 | Dawson et al. |
| 5,199,874 | A | 4/1993 | Campagnuolo et al. |
| 5,518,401 | A | 5/1996 | FitzGerald et al. |
| 6,065,404 | A | 5/2000 | Ripingill, Jr. et al. |
| 2006/0166171 | A1 | 7/2006 | Preston et al. |
| 2007/0166667 | A1 | 7/2007 | Jones et al. |
| 2009/0081619 | A1 | 3/2009 | Miasnik |

OTHER PUBLICATIONS

No Author, "Pinpuller Concept," TiNi Aerospace, Inc., http://www.tiniaerospace.com/pdf/pinpullerconcept.pdf, printed Jul. 13, 2010.
No Author, "Shape Memory Alloy Actuators," Autosplice Inc., http://www.autosplice.com/shape-memory-actuators/, printed Jul. 13, 2010.

*Primary Examiner* — Kurt Fernstrom
(74) *Attorney, Agent, or Firm* — Withrow & Terranova, PLLC

(57) ABSTRACT

A non-pyrotechnic cueing device for use in non-lethal gunfire activities. The cueing device includes a fluid container for containing a fluid, and a fluid discharge assembly in communication with the fluid container. The fluid discharge assembly is adapted to force the fluid from the fluid container through an opening of the fluid container upon activation. A trigger having an engaged position with respect to the fluid discharge assembly and a disengaged position with respect to the fluid discharge assembly is adapted to activate the fluid discharge assembly upon movement to the disengaged position. A thermally responsive non-pyrotechnic trigger actuator is coupled to the trigger and is adapted to selectively move the trigger to the disengaged position.

20 Claims, 6 Drawing Sheets

NON-PYROTECHNIC CUEING DEVICE

FIELD OF THE DISCLOSURE

Embodiments disclosed herein relate generally to cueing devices used in exercises involving weapons, and in particular to a non-pyrotechnic cueing device that discharges a fluid, such as a water-based paint, upon activation.

BACKGROUND

Weapons that emit non-lethal gunfire are used by the military and civilians in a variety of activities, including combat training and entertainment activities. Typically, the participants in such an activity carry a weapon that fires either a paintball or a laser beam in a direction the weapon is pointed when fired. In some instances, the participants may also wear an apparatus that signals, or cues, the participant and others when the participant has been struck by another participant's gunfire.

Paintball guns are one example of a weapon used in such activities. A paintball gun typically uses compressed gas to shoot one or more paintballs a relatively short distance from the gun toward the target. Ideally the paintball bursts upon impact with the target, and emits a water-based paint on the target, which can cue the target and observers that the target has been struck.

Laser guns are another example of weapons used in such activities. A laser gun fires a laser beam toward a target. The target includes a laser detector assembly which can emit an audible alarm upon detection of the laser beam. The audible alarm serves to cue the target and observers that the target has been struck.

In a military context, paintball guns offer certain advantages over laser guns. One advantage is that a paintball gun offers a more robust negative feedback cue—specifically, a visible paint that is emitted on a target that has been struck—and a tactile perception that is caused by the impact of the paintball on the target. On the other hand, paintball guns have a very limited range, which is not necessarily reflective of likely combat conditions. Moreover, paintball guns may not have a physical appearance that realistically resembles the actual weapons that are used by military personnel during combat.

Laser guns offer a much longer range than paintball guns, which may more realistically reflect actual combat conditions, and laser guns may also be designed to more closely resemble the actual weapons used by military personnel. However, the negative feedback is typically limited to an audible alarm, which, in the midst of an exercise, may not be heard by other participants or observers, or in some circumstances even by the target, and which does not provide any tactile feedback.

Accordingly, there is a need for a cueing device that can operate in conjunction with relatively long-range weapons, such as laser guns; can initiate a suitable negative feedback that can be perceived not only by the target, but by other participants and observers; and can be safely worn by participants in a non-lethal gunfire activity.

SUMMARY

Embodiments herein relate to a non-pyrotechnic cueing device that can be directly or indirectly coupled to a laser detector assembly and can emit a fluid on a participant participating in a non-lethal gunfire activity to indicate that the participant has been struck by non-lethal gunfire. Embodiments provide suitable negative feedback with long-range weapons, such as laser guns, to enhance realism and more closely simulate actual combat conditions.

In operation, the cueing device is coupled to a laser detector assembly, and is worn, or otherwise affixed to, the target. The cueing device includes a fluid container for holding a fluid, such as a water-based paint. The fluid container is in communication with a fluid discharge assembly that is adapted to force the fluid from the fluid container upon activation. In one embodiment, the fluid container includes an opening which is covered by a membrane that is adapted to seal the opening at a pressure below a breaching pressure. Upon activation of the fluid discharge assembly, the pressure within the fluid container is increased to a pressure above the breaching pressure, which causes the membrane to breach, and the pressure forces the fluid from the fluid container through the opening.

A trigger engages the fluid discharge assembly in a non-activated state of the cueing device. The trigger is coupled to a trigger actuator, which is adapted to selectively move the trigger from the engaged position to a disengaged position. The trigger actuator may comprise, for example, a shape memory material (SMM) wire that, when heated to an activation temperature, contracts sufficiently to move the trigger from the engaged position to the disengaged position and thereby activate the fluid discharge assembly. Preferably, the trigger actuator is thermally responsive and non-pyrotechnic.

In one embodiment, the SMM wire encircles a turnstile, or spool, and has a first end coupled to the trigger and a second end coupled to a surface that is fixed with respect to the trigger. The use of a spool allows a length of SMM wire sufficient to move the trigger from the engaged position to the disengaged position to fit in a relatively small space. Accordingly, the cueing device may be relatively small, and unobtrusive to the participant. The relatively small size of the cueing device also enables a participant to wear multiple cueing devices, if desired, such that a particular cueing device may be activated based on where on the participant's body the laser beam is detected.

The SMM wire may be heated to the activation temperature via a heater assembly that is in thermal communication with the SMM wire. The heater assembly may comprise any assembly suitable to heat the SMM wire, directly or indirectly, to the activation temperature.

In one embodiment, the cueing device may include, or be coupled to, a radio frequency (RF) control assembly. The RF control assembly may include an RF receiver that is adapted to receive an RF signal that is generated by a laser detector, such as a Multiple Integrated Laser Engagement System (MILES) assembly. The RF control assembly, upon receipt of the RF signal, activates the heater assembly to heat the SMM wire in order to actuate the trigger and cause the discharge of the fluid onto the participant.

In another embodiment, the cueing device may include, or be coupled to, a MILES assembly. Upon detection of a laser beam, i.e., a "strike" by another participant, the MILES assembly activates the heater assembly to heat the SMM wire to actuate the trigger and cause the discharge of the fluid onto the participant.

In one embodiment, the spool includes a spiral groove in which at least a portion of the SMM wire resides. The surface of the spiral groove may be coated with a low-coefficient of friction, relatively high-temperature material such as polyether ether ketone (PEEK).

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Embodiments disclosed herein include a non-pyrotechnic cueing device that is integral with, or can be directly or indirectly coupled to, a laser detector assembly and which can emit a fluid on a participant participating in a non-lethal gunfire activity to indicate that the participant has been struck by non-lethal gunfire. Typically, one disadvantage of non-pyrotechnic cueing devices is that such devices are substantially larger than pyrotechnic cueing devices. Larger non-pyrotechnic cueing devices can be obtrusive to participants, and may be relatively heavy. However, the use of smaller pyrotechnic cueing devices may be potentially dangerous to participants, can limit the venues in which the training may be conducted, and may require that additional protective clothing be worn by participants.

Embodiments disclosed herein include a relatively small non-pyrotechnic cueing device that provides one or more negative feedback indicators and can be worn by a participant without interference with the participant's training. The non-pyrotechnic cueing device can selectively emit a fluid, such as a water-based paint, upon the clothing or body of the participant that can be immediately seen by the participant, the other participants, and observers. The non-pyrotechnic cueing device also preferably generates a tactile sensation that can be felt by the participant.

Figure 1:
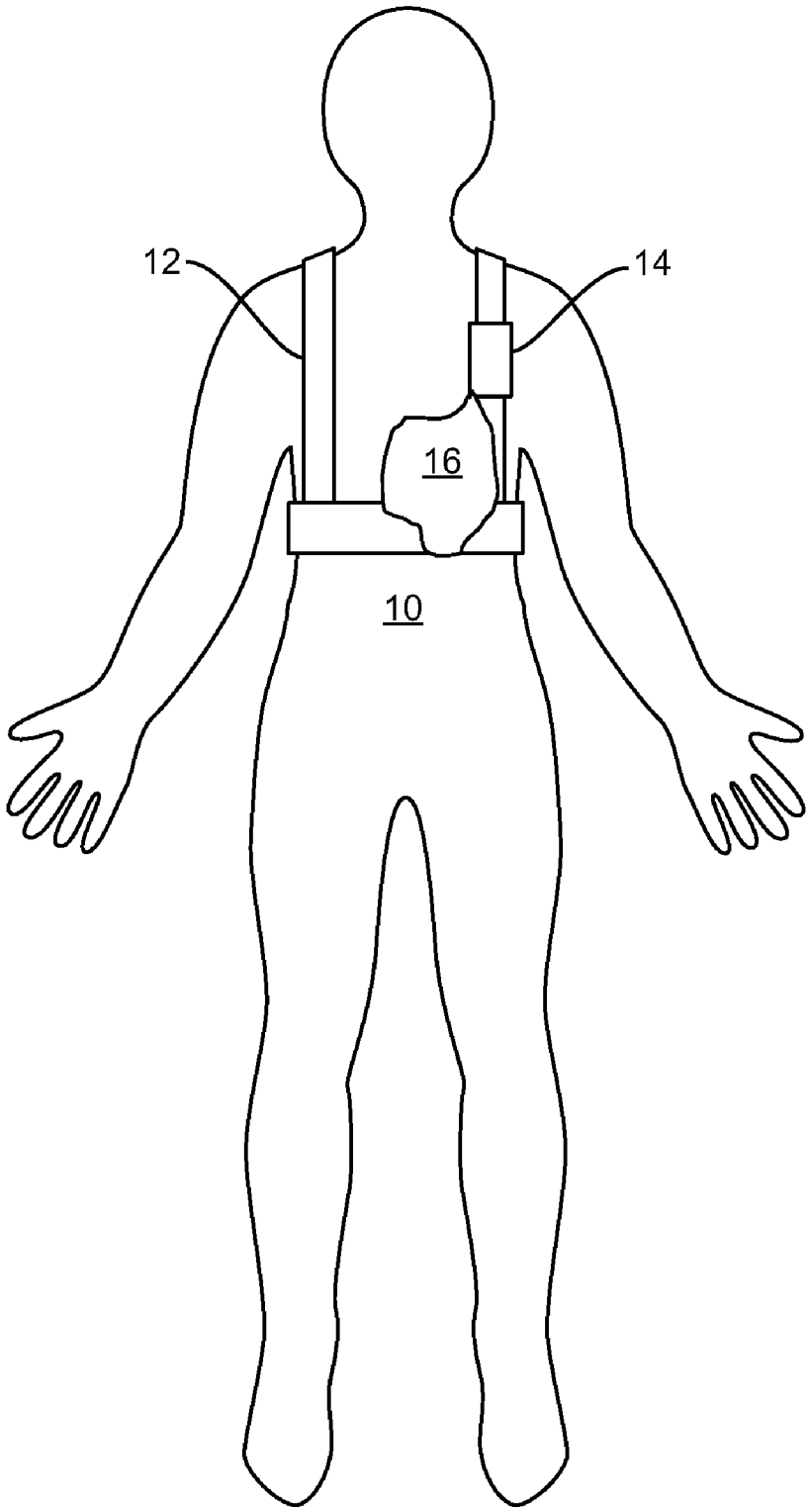
FIG. 1 is a high-level block diagram illustrating an exemplary use of a non-pyrotechnic cueing device according to one embodiment.

FIG. 1 is a high-level block diagram illustrating an exemplary use of a non-pyrotechnic cueing device according to one embodiment. A user, such as a participant 10 involved in a combat training exercise, wears a vest or harness 12 on which a non-pyrotechnic cueing device 14 (hereinafter called the cueing device 14 for purposes of brevity) is attached. The cueing device 14 is shown in an activated state, and has discharged a fluid 16 onto the body of the participant 10. The cueing device 14 would typically be activated upon detection of a strike by gunfire from a non-lethal weapon, such as a laser gun. While the fluid 16 may comprise any desirable fluid, in one embodiment, the fluid 16 comprises a mixture of propylene glycol, sorbitol, dye, wax, and water, such as is used in conventional paint balls. While only a single cueing device 14 is shown in FIG. 1, the participant 10 may wear multiple cueing devices 14 on different parts of his body, and a particular cueing device 14 may be selectively activated based on where on the participant 10 the strike was detected.

Figure 2A:
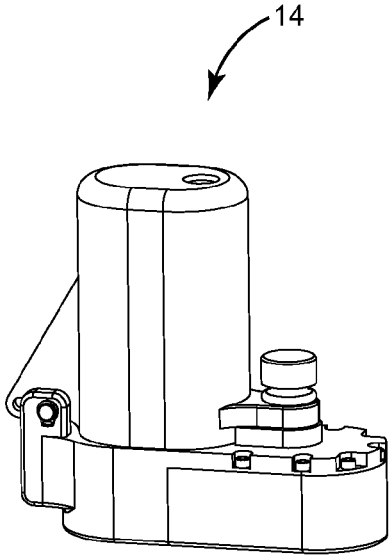
FIG. 2A is a collapsed view of an exemplary non-pyrotechnic cueing device according to one embodiment.
Figure 2B:
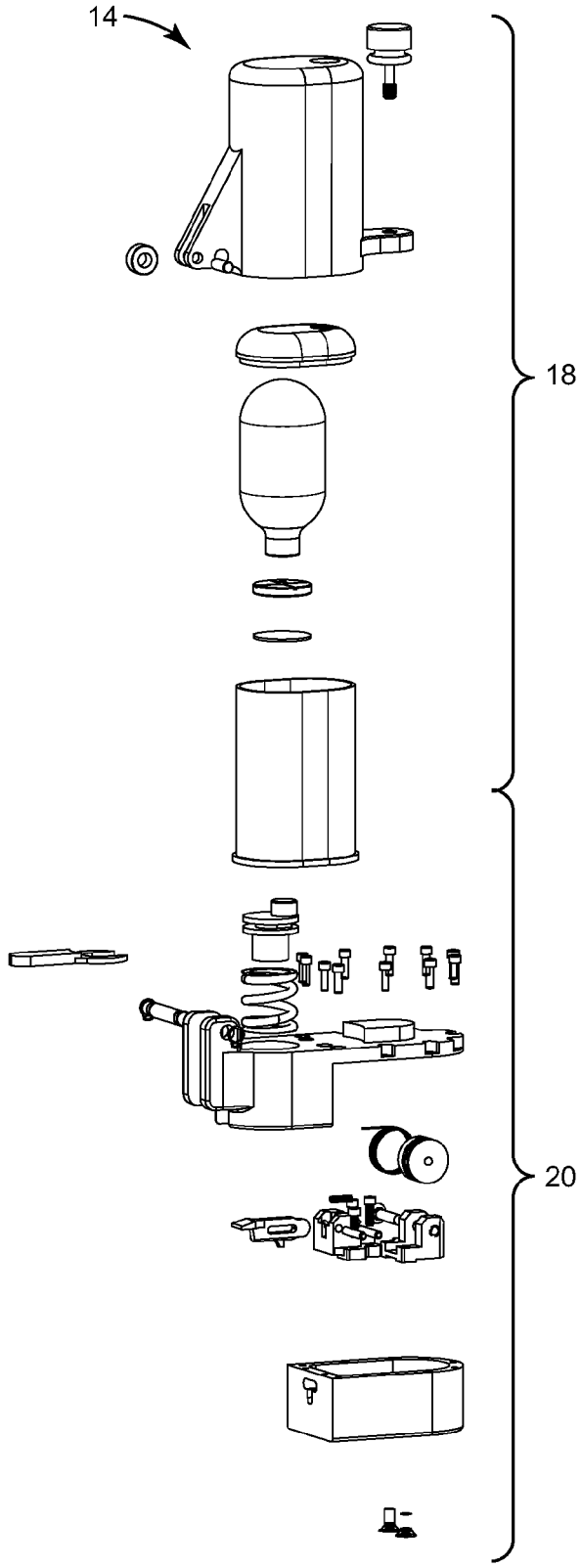
FIG. 2B is an exploded view of the exemplary non-pyrotechnic cueing device illustrated in FIG. 2A.

FIG. 2A is a collapsed view of an exemplary cueing device 14 according to one embodiment. The cueing device 14 is illustrated without other devices with which the cueing device 14 may be coupled, such as a radio frequency (RF) assembly or a Multiple Integrated Laser Engagement System (MILES) assembly, for example. FIG. 2B is an exploded view of the exemplary cueing device 14 illustrated in FIG. 2A. The components bracketed by the bracket 18 will be discussed in greater detail in FIG. 3, and the components bracketed by the bracket 20 will be discussed in greater detail in FIG. 4.

Figure 3:
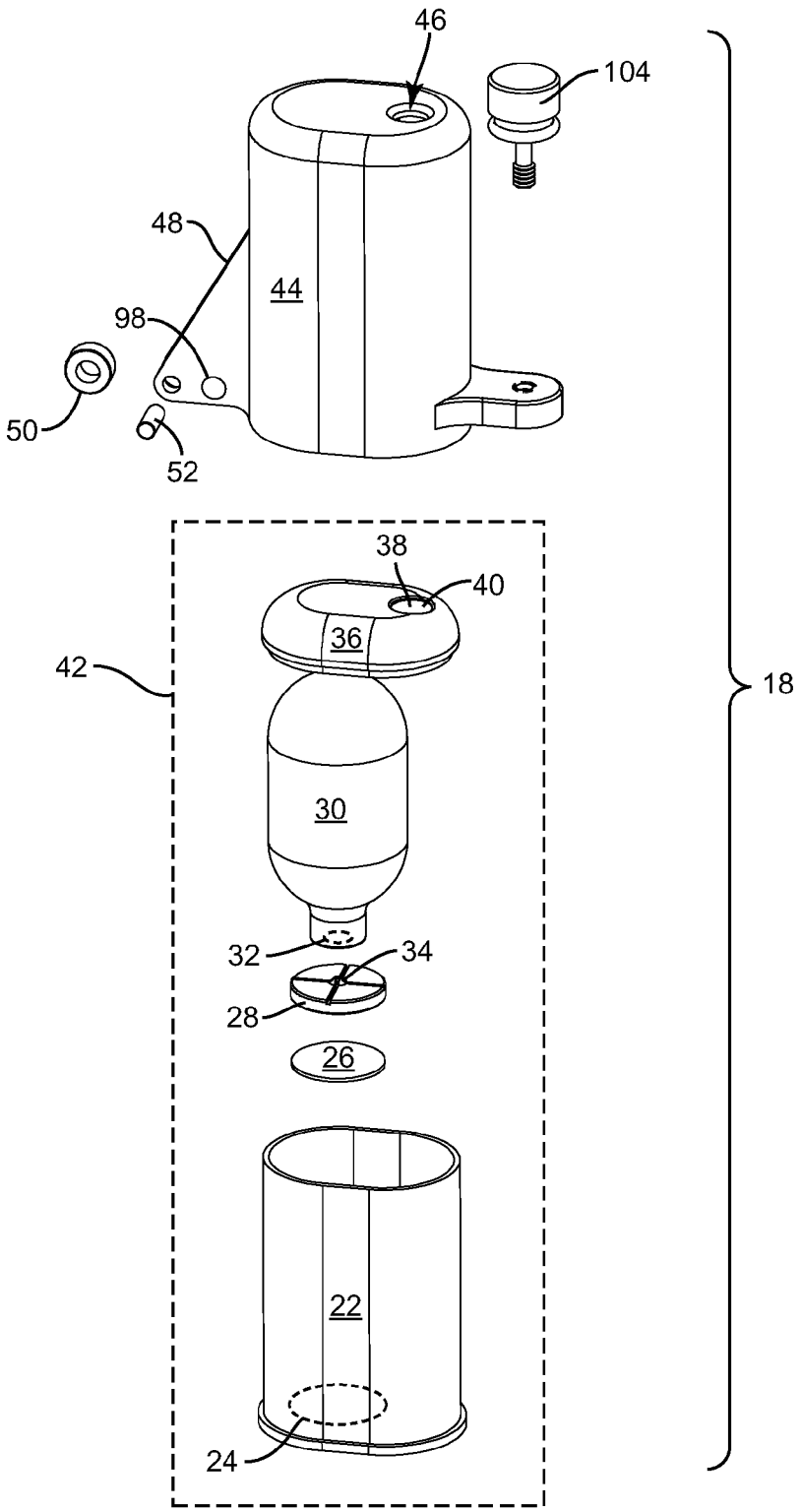
FIG. 3 is an exploded view illustrating in greater detail aspects of the non-pyrotechnic cueing device illustrated in FIGS. 2A and 2B.

FIG. 3 is an exploded view illustrating the components bracketed by the bracket 18 in FIG. 2 in greater detail. A receptacle 22 includes an opening 24 through which a hammer (FIG. 4) may be forced upon activation of the cueing device 14. A sealing member 26 covers the opening 24 and prevents the fluid in the receptacle 22 from flowing through the opening 24. A puncture plate 28 is positioned over the sealing member 26. A compressed gas cartridge 30 is positioned in the receptacle 22 such that a membrane 32 of the compressed gas cartridge 30 is positioned directly over a pin 34 on the puncture plate 28. The compressed gas cartridge 30 may comprise, for example, a $CO_2$ cartridge. In one embodiment, the compressed gas cartridge 30 comprises a 4 gram $CO_2$ cartridge.

A fluid, such as a water-based paint mixture, is poured into the receptacle 22, and partially or completely covers compressed gas cartridge 30. Thus, in one embodiment, the compressed gas cartridge 30 is contained within the receptacle 22. A sealing member 36 engages the top of the receptacle 22 to seal the fluid within the receptacle 22. The sealing member 36 includes an opening 38 which is covered by a breachable membrane 40 that breaches, or ruptures, when the pressure within the sealed receptacle 22 exceeds a particular pressure.

In one embodiment, the pin 34 is forced into the membrane 32 during activation of the cueing device 14 and ruptures the membrane 32, causing compressed gas to be discharged from the compressed gas cartridge 30 into the sealed receptacle 22. When the pressure inside the sealed receptacle 22 exceeds the strength of the breachable membrane 40, the breachable membrane 40 ruptures, and fluid is ejected forcibly through the opening 38. The sudden release of the fluid and compressed gas through the opening 38 causes a relatively strong tactile sensation that is likely noticed by the participant 10.

Thus, the participant 10 may be cued that he has been struck, even before learning that the fluid has been emitted onto his clothing.

The sealing member 36 in conjunction with the receptacle 22 and the sealing member 26 form a container for holding the fluid prior to activation of the cueing device 14. It will be understood that containers having different components, sizes, and geometries would also be suitable for use herein. The sealing member 36, the receptacle 22, the sealing member 26, the puncture plate 28, and the compressed gas cartridge 30, along with a fluid (not shown) in the receptacle 22 may be conveniently assembled into a replaceable paint cartridge 42 and sold separately from the other components discussed herein such that the cueing device 14 may be used repeatedly simply by replacing a paint cartridge 42 that has been used with a new, unused paint cartridge 42.

A cover 44 fits over and secures the paint cartridge 42 to a base of the cueing device 14 (FIGS. 2A and 2B). The cover 44 includes an opening 46 which is in fluid communication with the opening 38, and which allows the fluid to escape the cueing device 14 when the fluid is forced through the breachable membrane 40.

Figure 4:
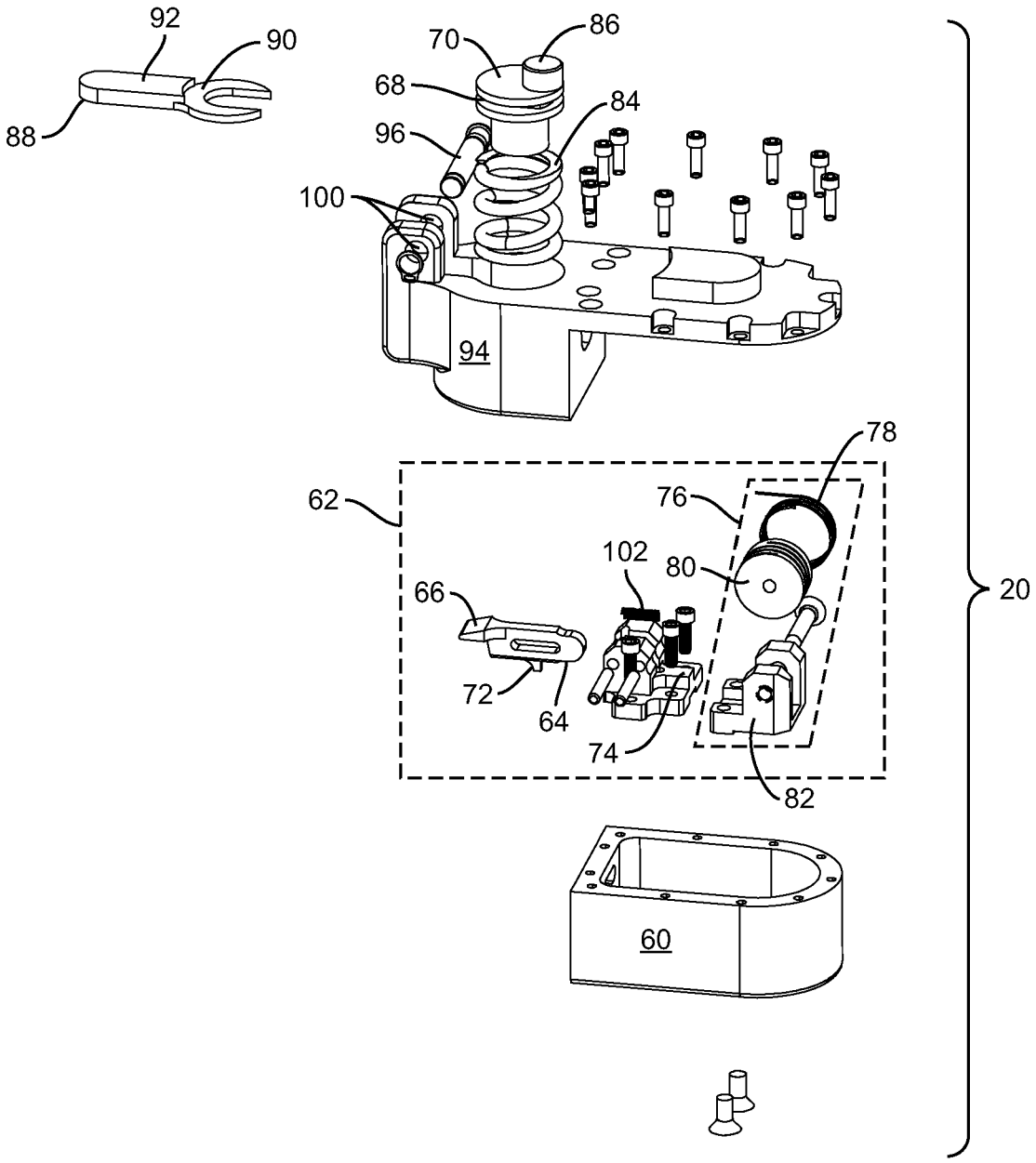
FIG. 4 is an exploded view illustrating in greater detail aspects of the non-pyrotechnic cueing device illustrated in FIGS. 2A and 2B.

The cover 44 includes a pivot projection 48 which includes a cam 50 that rides on an axle 52, and which may be used to "cock" a fluid discharge assembly as discussed in greater detail with regard to FIG. 4.

FIG. 4 is an exploded view illustrating the components bracketed by the bracket 20 in FIG. 2 in greater detail. A base 60 contains a trigger assembly 62 that is used to selectively activate the cueing device 14. The trigger assembly 62 includes a trigger 64 that has a projection 66 which engages a slot 68 in a hammer 70 when in an engaged position. The trigger 64 also includes an extension 72 that rides in a channel (FIG. 6) of a trigger guide 74. The trigger 64 has an engaged position and a disengaged position. When in the engaged position, the projection 66 is engaged with the slot 68 and retains the hammer 70, as discussed in greater detail below. When in a disengaged position, the projection 66 is not in the slot 68, allowing the hammer 70 to drive the puncture plate 28 (FIG. 3) into the membrane 32 of the compressed gas cartridge 30.

The trigger assembly 62 also includes a trigger actuator 76. In one embodiment, the trigger actuator 76 includes a shape memory material (SMM) wire 78. SMM refers to materials that have a normal state and a deformed state, and when in the deformed state can be heated to or above an activation temperature by appropriate thermal stimulus to cause the SMM to return to the normal state. SMMs include shape memory alloys (SMA), such as nickel titanium alloys sold under the brand FLEXINOL® by Dynalloy, Inc., 14762 Bentley Circle, Tustin, Calif.; shape memory polymers; and the like. An SMM wire may be stretched from a normal state to a deformed state. Typically, the deformed state of an SMM wire is about 3% to about 6% longer than its normal state, although this may differ depending on the exact alloy used to make the SMM wire. Upon suitable thermal stimulus to or above an activation temperature, the SMM wire will contract back to its normal length. Thus, the trigger actuator 76 is preferably thermally responsive and non-pyrotechnic.

In one embodiment, a first end of the SMM wire 78 is connected to the trigger 64 and a second end of the SMM wire 78 is connected to a surface of the cueing device 14 that is fixed with respect to the trigger 64. As the SMM wire 78 is heated to or above the activation temperature, the SMM wire 78 contracts and pulls the trigger 64 from the engaged position to the disengaged position. In one embodiment, the SMM wire 78 is wrapped around a turnstile or spool 80. Use of the spool 80 enables a sufficiently long SMM wire 78 to be used such that the trigger 64 may be moved a sufficient distance to disengage the projection 66 from the slot 68 of the hammer 70. The use of the spool 80 in conjunction with the SMM wire 78 results in a relatively small trigger actuator 76 and substantially reduces the size of the cueing device 14 which would otherwise be necessary. The spool 80 comprises a material that stays rigid at a temperature at least slightly above the activation temperature. In a preferred embodiment, the spool 80 comprises a ceramic material. Preferably, the spool 80 has a Rockwell hardness greater than about R112 and a coefficient of friction greater than about 0.20.

The spool 80 rests in a spool holder 82. The second end of the SMM wire 78 may, for example, be fixed to a surface of the spool holder 82. The spool holder 82 and/or the SMM wire 78 are in thermal communication with a heater assembly (not illustrated in FIG. 4) which selectively applies heat to the spool holder 82 and/or directly to the SMM wire 78 to cause the SMM wire 78 to reach the activation temperature and contract to move the trigger 64 from the engaged position to the disengaged position. The heater assembly may, for example, heat the SMM wire 78 to the activation temperature via direct or indirect contact with an electric current, or via any other mechanism sufficient to cause the SMM wire 78 to heat to the activation temperature within a desired period of time.

It will be recognized that the trigger actuator 76 is one exemplary thermally responsive non-pyrotechnic actuator, but that other thermally responsive non-pyrotechnic actuators may be suitable for use in various embodiments described herein.

Upon disengagement of the projection 66 from the slot 68, a spring 84 forces the hammer 70 towards the interior of the receptacle 22. A projection 86 on the hammer 70 is axially aligned with the pin 34, and drives the pin 34 into the membrane 32, causing the membrane 32 to rupture and resulting in a release of compressed gas into the receptacle 22. Thus, the spring 84, the hammer 70, the pin 34, and the compressed gas cartridge 30 comprise a fluid discharge assembly that is in fluid communication with the container, and that, when activated, forces the fluid through the membrane 32.

It will be recognized that other fluid discharge assemblies may be suitable for use in various embodiments described herein. For example, rather than the use of the compressed gas cartridge 30, in one embodiment a plate having a shape that matches the interior of the receptacle 22 is placed in the bottom of the receptacle 22 prior to filling the receptacle 22 with a fluid. Upon activation, the spring 84 urges the hammer 70 through the opening 24 in the receptacle 22, forcing the plate along the interior of the receptacle 22 and forcing the fluid in the receptacle 22 into a diminishing volume. As the volume diminishes, the pressure eventually reaches a pressure that causes the breachable membrane 40 to breach, emitting the fluid through the opening 38. After activation, the breached paint cartridge 42 may be replaced with a new paint cartridge 42. The fluid discharge assembly is then cocked in preparation for re-use.

A cocking extension 88 includes a head 90 which engages the slot 68 and a cam roller surface 92. Referring to both FIGS. 3 and 4, the cover 44 is affixed to a base 94 via a pin 96 which extends through a hole 98 in the pivot projection 48 and through holes 100 in the base 94. The cover 44 may then be pivoted about the pin 96 so that the cam 50 contacts the cam roller surface 92 and rides along the cam roller surface 92 as the cover 44 is pivoted, forcing the cocking extension 88 downward. The movement of the cocking extension 88 forces the hammer 70 against the spring 84, and thereby compresses the spring 84. A spring 102 urges the trigger 64 in a direction toward the hammer 70 and when the slot 68 and the projection 66 are aligned, urges the projection 66 into the engaged position within the slot 68. The cover 44 may then be pivoted in the reverse direction about the pin 96 until the cover contacts the base 94 in a closed position. A thumbscrew 104 may be used to affix the cover 44 to the base 94.

Figure 5:
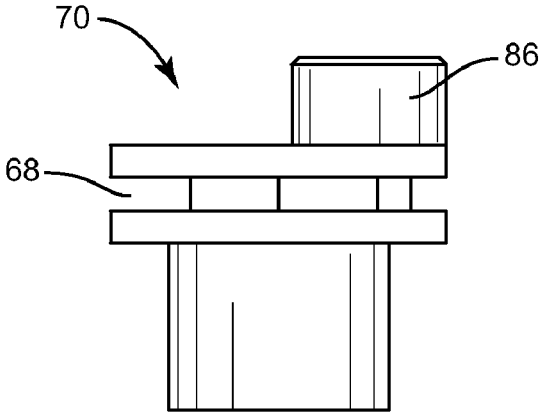
FIG. 5 is a side view of an exemplary hammer according to one embodiment.

FIG. 5 is a side view of the hammer 70. The slot 68 may be circumferential, although other geometries would be suitable to enable the cocking extension 88 and the trigger 64 to engage the hammer 70.

Figure 6:
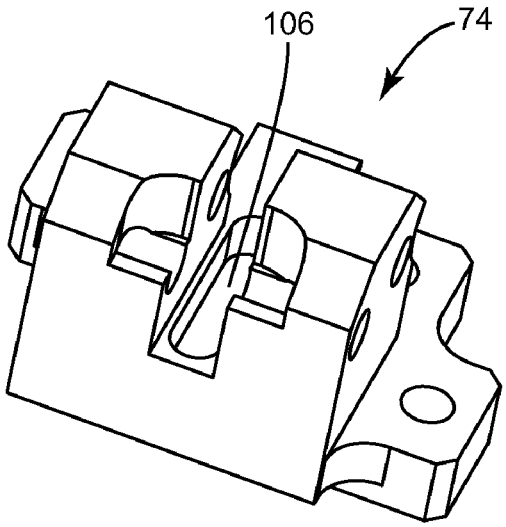
FIG. 6 is an enlarged view of an exemplary trigger guide according to another embodiment.

FIG. 6 is an enlarged view of the trigger guide 74. The trigger guide 74 includes a channel 106 in which the trigger extension 72 rides when moving from the engaged position to the disengaged position.

Figure 7:
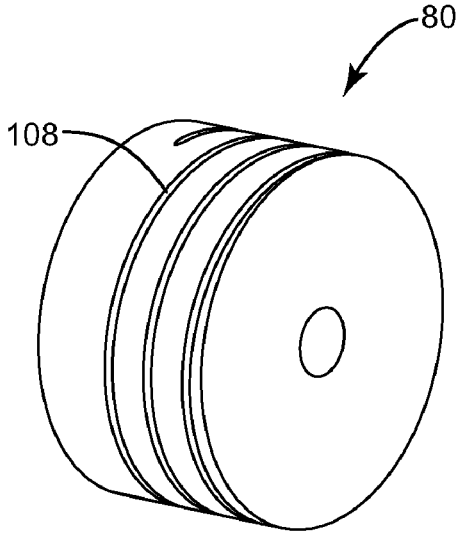
FIG. 7 is an enlarged view of an exemplary spool, according to one embodiment.

FIG. 7 is an enlarged view of the spool 80, according to one embodiment. The spool 80 may include a helical, or spiral, groove 108 which at least partially contains the SMM wire 78. The spool 80 may be made of a slick, low coefficient of friction material that withstands relatively high temperatures such as polyether ether ketone (PEEK).

Figure 8:
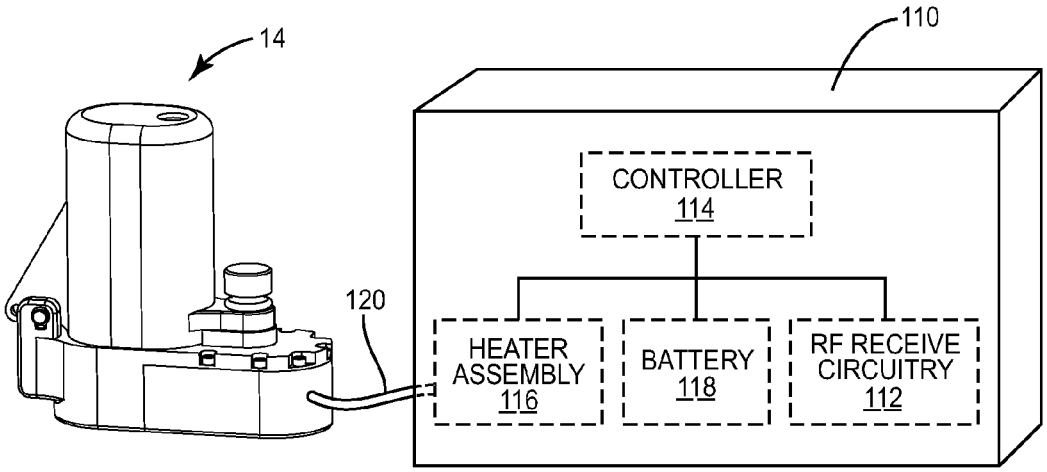
FIG. 8 illustrates a non-pyrotechnic cueing device coupled to a radio frequency (RF) assembly according to one embodiment.

The cueing device 14 may include, or be coupled to, a heating assembly that selectively provides thermal energy to the SMM wire 78 directly, or indirectly, such as through the spool 80. The heating assembly may be coupled to control circuitry that initiates the heating assembly in response to a signal. FIG. 8 illustrates one embodiment wherein the cueing device 14 is coupled to a RF assembly 110. The RF assembly 110 includes an RF receiver, such as RF receive circuitry 112, which receives messages transferred over a desired frequency. In one embodiment, the RF receive circuitry 112 receives RF signals generated by a MILES assembly. A MILES assembly includes laser detectors which detect a laser strike from a laser gun. The MILES assembly can send an RF signal to the RF receive circuitry 112 indicating that the participant 10 has been struck. A controller 114 interprets the message, and the controller 114 in conjunction with the RF receive circuitry 112 operates as an RF control assembly that initiates a heater assembly 116, which draws energy from a battery 118. The heater assembly 116 heats the SMM wire 78 to the activation temperature via an insulated wire 120, which causes the contraction of the SMM wire 78 and disengagement of the trigger 64. While for purposes of illustration, the RF assembly 110 is shown as a separate module from the cueing device 14, in another embodiment the RF assembly 110 is integral with the cueing device 14.

In one embodiment, the controller 114 may also be adapted to communicate with a computer to provide tracking information about the participant wearing the cueing device 14, and to provide event information to the computer either in real time or subsequent to participation for after-action training reviews. Such information may identify, for example, when the participant was hit by a strike, who hit the participant, where the strike took place geographically, and the like.

Figure 9:
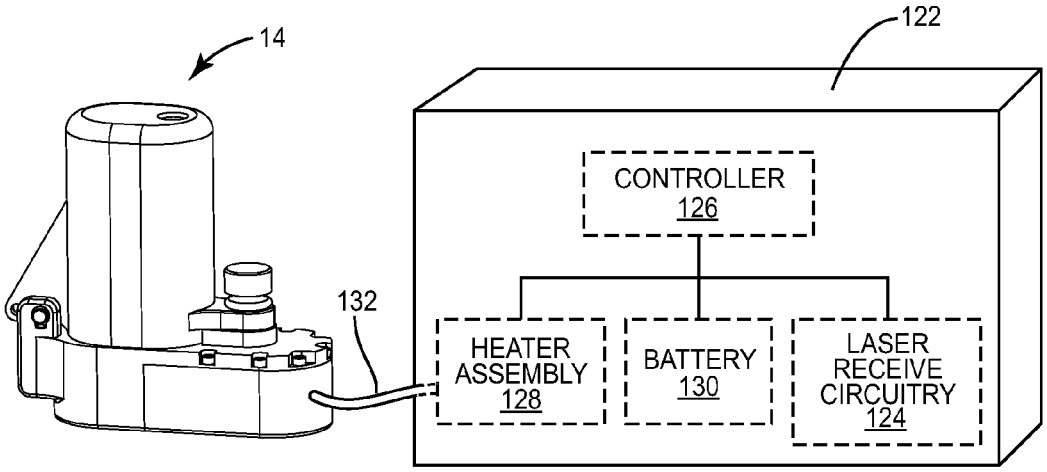
FIG. 9 illustrates a non-pyrotechnic cueing device coupled to a Multiple Integrated Laser Engagement System (MILES) assembly according to one embodiment.

FIG. 9 illustrates an embodiment wherein the cueing device 14 is coupled to a MILES assembly 122. The MILES assembly 122 has one or more laser detectors (not shown) coupled to a laser receive circuitry 124. Upon detection by the laser receive circuitry 124 of a laser strike, a controller 126 initiates a heater assembly 128, which draws energy from a battery 130. The heater assembly 128 heats the SMM wire 78 to the activation temperature via an insulated wire 132, which causes the contraction of the SMM wire 78 and the disengagement of the trigger 64. While for purposes of illustration, the MILES assembly 122 is shown as a separate module from the cueing device 14, in another embodiment the MILES assembly 122 is integral with the cueing device 14.

Among other advantages discussed herein, the cueing device 14 enables the use of a long range weapon, such as a laser gun, with a very visible cue, such as a water-based paint, without the need to wear protective clothing, such as a paintball mask, that is typically associated with paintball guns. This increases the realism and makes the training exercise more effective. Moreover, because the cueing device 14 causes both a visual cue and a relatively strong tactile sensation upon discharge of the fluid, there is no need for participants to switch from laser weapons to paintball guns as they move from field exercises to urban exercises, as is currently commonly done.

The heater assembly may comprise a voltage source that passes a current through the SMM wire 78, for example. In one embodiment, one terminal of the battery is electrically coupled to one end of the SMM wire 78, and the other terminal of the battery is electrically coupled to the other end of the SMM wire 78. A transistor may be coupled in series to provide a switch for selectively activating the heater assembly. In one embodiment, the voltage source may be coupled to a capacitor to selectively instantaneously deliver a relatively substantial amount of current to the SMM wire 78.

Those skilled in the art will recognize improvements and modifications to the preferred embodiments of the present disclosure. All such improvements and modifications are considered within the scope of the concepts disclosed herein and the claims that follow.

What is claimed is:

1. A non-pyrotechnic cueing device, comprising:

a fluid container for containing fluid;

a fluid discharge assembly adapted to force fluid from the fluid container through an opening of the fluid container upon activation;

a trigger having an engaged position and adapted to activate the fluid discharge assembly when in a disengaged position; and a thermally responsive non-pyrotechnic trigger actuator coupled to the trigger and adapted to selectively move the trigger to the disengaged position.

2. The non-pyrotechnic cueing device of claim 1, wherein the thermally responsive non-pyrotechnic trigger actuator is in thermal communication with a heating assembly, wherein the thermally responsive non-pyrotechnic trigger actuator is adapted to selectively move the trigger to the disengaged position upon reaching an activation temperature.

3. The non-pyrotechnic cueing device of claim 1, wherein the thermally responsive non-pyrotechnic trigger actuator is in thermal communication with a heating assembly which provides thermal energy in response to a receipt of a strike by a Multiple Integrated Laser Engagement System (MILES) assembly, and wherein the thermally responsive non-pyrotechnic trigger actuator is adapted to selectively move the trigger to the disengaged position upon reaching an activation temperature.

4. The non-pyrotechnic cueing device of claim 2, further comprising:

the heating assembly; and a controller electrically coupled to the heating assembly and to a battery, wherein the controller is adapted to pass an electric current from the battery to the heating assembly upon receipt of a signal.

5. The non-pyrotechnic cueing device of claim 4, wherein the signal is a radio frequency (RF) signal, and further comprising:

an RF receiver coupled to the controller, the RF receiver adapted to receive the signal.

6. The non-pyrotechnic cueing device of claim 5, wherein the RF receiver receives the RF signal from a Multiple Integrated Laser Engagement System (MILES) assembly.

7. The non-pyrotechnic cueing device of claim 5, further comprising a MILES assembly, and wherein the RF receiver receives the RF signal from the MILES assembly.

8. The non-pyrotechnic cueing device of claim 7, wherein the RF signal is generated in response to detection of a laser beam by the MILES assembly.

9. The non-pyrotechnic cueing device of claim 1, wherein the thermally responsive non-pyrotechnic trigger actuator further comprises a shape memory material (SMM) wire having a first end and a second end, the first end connected to the trigger, and the second end connected to a surface that is fixed with respect to the trigger.

10. The non-pyrotechnic cueing device of claim 9, further comprising a spool, wherein the SMM wire encircles the spool, and wherein upon reaching an activation temperature the SMM wire contracts about the spool and thereby moves the trigger to the disengaged position.

11. The non-pyrotechnic cueing device of claim 10, wherein the spool comprises a spiral groove in which at least a portion of the SMM wire resides.

12. The non-pyrotechnic cueing device of claim 11, wherein a surface of the spiral groove has a coefficient of friction greater than about 0.20.

13. The non-pyrotechnic cueing device of claim 1, wherein the fluid container contains paint.

14. The non-pyrotechnic cueing device of claim 1, further comprising a membrane adapted to seal the opening below a breaching pressure, and wherein the fluid discharge assembly, upon activation, is adapted to increase a pressure in the fluid container to a pressure above the breaching pressure to cause the membrane to breach, thereby forcing the fluid from the fluid container through the opening.

15. The non-pyrotechnic cueing device of claim 1, wherein the fluid discharge assembly further comprises a $CO_2$ cartridge in fluid communication with the fluid container, the $CO_2$ cartridge comprising a membrane, and wherein upon activation, the membrane is breached.

16. The non-pyrotechnic cueing device of claim 15, wherein the $CO_2$ cartridge is contained within the fluid container.

17. The non-pyrotechnic cueing device of claim 1, wherein the non-pyrotechnic cueing device is adapted to be coupled to a harness worn by a user.

18. A non-pyrotechnic cueing device, comprising:

a fluid container for containing a fluid;

a fluid discharge assembly adapted to force the fluid from the fluid container through an opening of the fluid container upon activation;

a trigger having an engaged position with respect to the fluid discharge assembly and a disengaged position with respect to the fluid discharge assembly;

a thermally responsive non-pyrotechnic trigger actuator coupled to the trigger and adapted to move the trigger to the disengaged position upon reaching an activation temperature;

a heating assembly thermally coupled to the thermally responsive non-pyrotechnic trigger actuator; and an radio frequency (RF) control assembly adapted to receive an RF signal indicating contact via a laser beam and to activate the heating assembly in response thereto.

19. The non-pyrotechnic cueing device of claim 18, wherein the RF control assembly further comprises:

an RF receiver coupled to a controller, wherein the controller is coupled to the heating assembly and to a battery, and wherein the controller is adapted to activate the heating assembly upon receipt of the RF signal.

20. A non-pyrotechnic cueing device, comprising:

a fluid container for containing a fluid;

a fluid discharge assembly adapted to force the fluid from the fluid container through an opening of the fluid container upon activation;

a trigger having an engaged position with respect to the fluid discharge assembly and a disengaged position with respect to the fluid discharge assembly;

a thermally responsive non-pyrotechnic trigger actuator coupled to the trigger and adapted to move the trigger to the disengaged position upon reaching an activation temperature;

a heating assembly thermally coupled to the thermally responsive non-pyrotechnic trigger actuator; and a Multiple Integrated Laser Engagement System (MILES) assembly coupled to the heating assembly and including a laser detector, the MILES assembly adapted to initiate the heating assembly to heat the thermally responsive non-pyrotechnic trigger actuator to the activation temperature upon detection of a laser beam.

* * * * *